US008960426B2

(12) United States Patent
Kelly et al.

(10) Patent No.: US 8,960,426 B2
(45) Date of Patent: Feb. 24, 2015

(54) ARCHERY BOW CASE

(71) Applicant: Bow Anchor Products, Rockwall, TX (US)

(72) Inventors: Eddy D. Kelly, Rockwall, TX (US); Casey S. Kelly, Rockwall, TX (US)

(73) Assignee: Bow Anchor Products, Rockwall, TX (US)

( * ) Notice: Subject to any disclaimer, the term of this patent is extended or adjusted under 35 U.S.C. 154(b) by 0 days.

(21) Appl. No.: 13/840,343

(22) Filed: Mar. 15, 2013

(65) Prior Publication Data

US 2013/0199951 A1 Aug. 8, 2013

Related U.S. Application Data

(63) Continuation-in-part of application No. 12/783,672, filed on May 20, 2010, now abandoned.

(51) Int. Cl.

| | |
|---|---|
| ***A45C 7/00*** | (2006.01) |
| ***B65D 85/20*** | (2006.01) |
| ***F41B 5/14*** | (2006.01) |
| ***F41A 23/18*** | (2006.01) |
| *A63B 71/00* | (2006.01) |

(52) U.S. Cl.

CPC ..... *F41B 5/1457* (2013.01); *F41A 23/18* (2013.01); *A63B 71/0036* (2013.01); *A63B 2210/50* (2013.01); *A63B 2244/04* (2013.01)

USPC ..... 206/315.1; 190/107; 248/213.2

(58) Field of Classification Search

USPC ..... 206/315.1, 315.11; 248/151, 125.8, 248/213.2; 190/1, 109, 107

See application file for complete search history.

(56) References Cited

U.S. PATENT DOCUMENTS

| | | | | | |
|---|---|---|---|---|---|
| 1,539,112 | A | * | 5/1925 | Gloekler | 248/151 |
| 2,274,077 | A | * | 2/1942 | Marzolf | 248/151 |
| 2,277,435 | A | * | 3/1942 | Howe | 108/35 |
| 2,372,077 | A | | 3/1944 | Glinecki | |
| 2,358,883 | A | * | 9/1944 | Rothschild | 190/12 R |
| 2,638,397 | A | | 11/1951 | Wykoff | |
| 2,579,040 | A | * | 12/1951 | Forrest | 248/151 |
| 2,759,576 | A | * | 8/1956 | Townsend | 190/11 |
| 3,368,858 | A | | 2/1968 | Motter et al. | |
| 3,408,027 | A | * | 10/1968 | Price | 248/151 |
| 4,034,518 | A | | 7/1977 | Trecker | |
| 4,244,632 | A | * | 1/1981 | Molinari | 312/231 |
| 4,322,905 | A | * | 4/1982 | Kruse | 40/610 |

(Continued)

OTHER PUBLICATIONS

Doskocil SE 44 Single Bow Case, Motorcycle Superstore, Apr. 2, 2010, 2 pages.

(Continued)

*Primary Examiner* — Jacob K Ackun

(74) *Attorney, Agent, or Firm* — Smith IP Services, P.C.

(57) ABSTRACT

A bow case that includes a body with a bottom, a top, four sides, an internal storage area, at least one removable leg that supports the body in a raised position, and a mounting bracket that removably attaches the leg to the body. Area of a rear side is greater than an area of a front side. Also, left and right sides may be inclined from a rear side to a front side. A bow case that includes a body with a top, a bottom, an internal storage area, and an internal storage cavity, where the bow case body is trapezoidally shaped. The cavity is externally accessible while the body remains closed, and any contents stored in the internal storage area are prevented from exiting the body as the body is rotated in any direction while the body is closed.

6 Claims, 9 Drawing Sheets

(56) References Cited

U.S. PATENT DOCUMENTS

| | | | | |
|---|---|---|---|---|
| 4,372,630 | A | 2/1983 | Fuhri | |
| 4,938,326 | A * | 7/1990 | Pfeiffer | 190/109 |
| 4,986,395 | A * | 1/1991 | Lewis | 190/1 |
| 5,002,247 | A * | 3/1991 | Dispenza et al. | 248/188 |
| 5,036,975 | A | 8/1991 | Chow | |
| 5,108,031 | A * | 4/1992 | Watson | 229/199 |
| 5,333,823 | A | 8/1994 | Joseph | |
| 5,366,071 | A | 11/1994 | Laszlo | |
| 5,495,947 | A | 3/1996 | Zarske | |
| 5,553,717 | A | 9/1996 | Minneman et al. | |
| 5,688,287 | A * | 11/1997 | Cline | 5/310 |
| 5,730,282 | A | 3/1998 | Bureau | |
| 5,913,380 | A | 6/1999 | Gugel et al. | |
| 6,032,796 | A | 3/2000 | Hopper et al. | |
| 6,068,355 | A * | 5/2000 | Thorp | 312/241 |
| 6,282,084 | B1 | 8/2001 | Goerdt et al. | |
| 6,302,097 | B1 | 10/2001 | Rivera | |
| 6,390,294 | B1 | 5/2002 | Fiore, Jr. et al. | |
| 6,543,613 | B2 | 4/2003 | Belanger | |
| D475,196 | S | 6/2003 | Vanskiver et al. | |
| 6,571,946 | B2 | 6/2003 | Fiore, Jr. | |
| 6,811,006 | B1 * | 11/2004 | Mundle | 190/11 |
| 6,920,977 | B1 | 7/2005 | Vanskiver et al. | |
| 7,055,847 | B2 | 6/2006 | Miller et al. | |
| 7,278,537 | B2 | 10/2007 | Lown et al. | |
| 8,172,077 | B1 | 5/2012 | Gray | |
| 2002/0020655 | A1 | 2/2002 | McKsymick | |
| 2002/0063072 | A1 | 5/2002 | Pham | |
| 2003/0116457 | A1 | 6/2003 | Belanger | |
| 2003/0150964 | A1 | 8/2003 | Sherer et al. | |
| 2003/0221982 | A1 | 12/2003 | Cook et al. | |
| 2004/0159578 | A1 | 8/2004 | Lieffring et al. | |
| 2006/0037873 | A1 | 2/2006 | Elgart | |
| 2007/0158509 | A1 * | 7/2007 | Hubbell | 248/171 |
| 2008/0000788 | A1 | 1/2008 | Kelly | |
| 2009/0078593 | A1 | 3/2009 | Patstone | |
| 2011/0284406 | A1 | 11/2011 | Kelly | |

OTHER PUBLICATIONS

Silver Lock Single Bow Case Details and Product Specifications, Epinions.com, Apr. 2, 2010, 3 pages.

Office Action issued Jun. 7, 2012 for U.S. Appl. No. 12/783,672, 10 pages.

Office Action issued Jan. 29, 2013 for U.S. Appl. No. 12/783,672, 13 pages.

* cited by examiner

FIG. 6
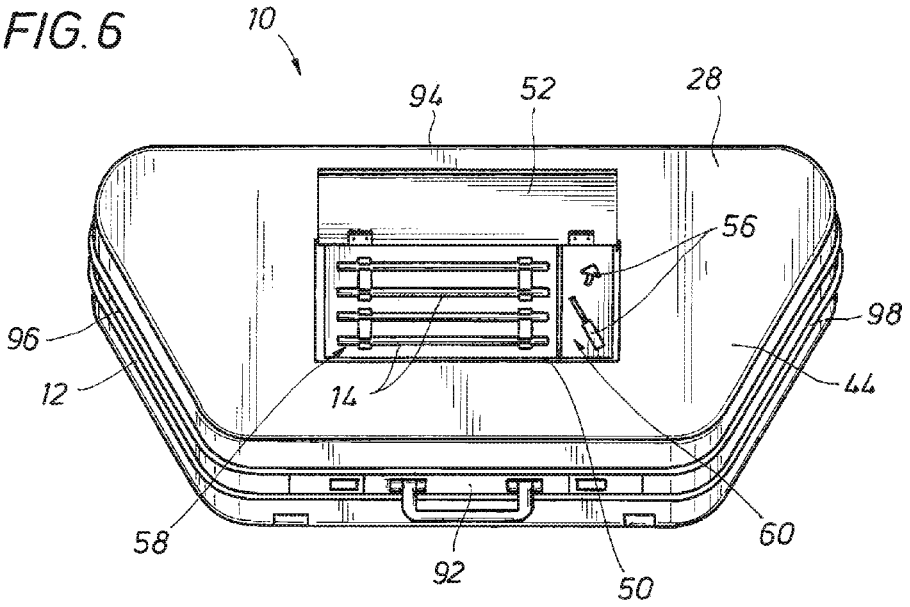
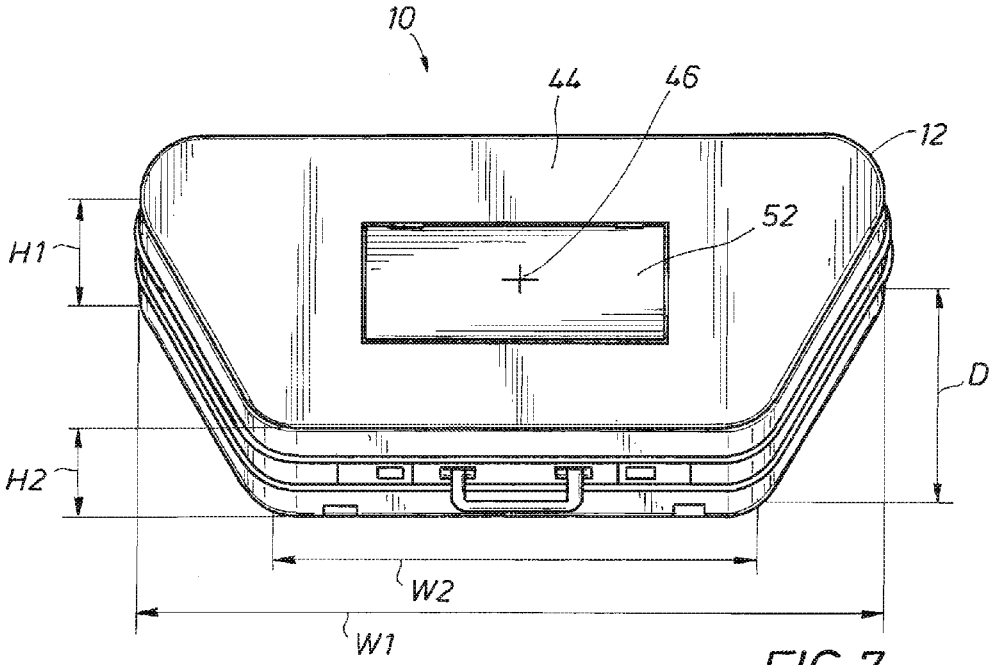
FIG. 7

ARCHERY BOW CASE

CROSS-REFERENCE TO RELATED APPLICATION

The present application is a continuation in part of U.S. application Ser. No. 12/783,672 filed on 20 May 2010. The entire disclosure of this prior application is incorporated herein by this reference.

BACKGROUND

This disclosure relates generally to a storage case and, in an embodiment described herein, more particularly to a case, with removable legs and a storage cavity, for storing and transporting archery equipment.

Various storage cases exist to hold and protect archery equipment when transporting to and from hunting or archery competition sites. However, because many archers carry additional items, such as arrowheads, various tools (e.g. a knife, an adjustment tool, screw driver, small hammer, wire cutters, etc.), bowstrings, flash lights, wrist guards, arm guards, glasses, polishing gel, lubrication, first aid items, papers, certifications, cell phone, keys, wallet, credit cards, identification, firearms, ammunition, etc., additional storage containers or bags are often necessary. These additional items can be burdensome for the archer to carry when traveling to and from these sites. This difficulty becomes greater when the sites are located in remote areas.

Some storage cases include internal compartments that allow the archer to better organize these additional items into one carrying case. However, if any of these additional items are needed, the storage case must be opened to retrieve them. This usually requires placing the case on the ground, kneeling down beside the case, and then opening the case to retrieve the needed item. In some hunting situations, the ground may be muddy, which makes it more difficult to keep the equipment clean.

There is another problem with setting a bow down when making adjustments to the equipment or retrieving arrows from a target after a practice round. An archer will usually lay the bow on top of a closed case or back inside an open case to make adjustments or retrieve arrows. This is more difficult when the case is lying on the ground.

Yet another problem exists when accessing these additional items stored in an internal compartment of the case. When packing for a trip, the hunter may pack the case underneath several other things required for the journey. Unfortunately, it is often necessary to retrieve some or all of the additional items stored in the compartment after the packing is complete. This requires the case to be fully unpacked from under the other things before the case can be opened to access the internal compartment.

Therefore, it may be seen that improvements are needed in the art of storage cases for archery equipment. These improvements may be useful in applications other than archery storage cases.

SUMMARY

In the present specification, a portable bow case is provided which brings improvements to the art of storage cases for archery equipment. One example is described below in which a bow case body includes a bottom, a top, four sides, and an internal storage area, where a front side has a smaller area than a rear side, a removable leg supports the case in a raised position, and a mounting bracket that removably attaches the leg to the body.

Another example is described below in which a trapezoidally shaped bow case includes a top, a bottom, an internal storage area, and an internal storage cavity. The internal storage cavity is externally accessible while the case remains closed and any contents of the internal storage area are prevented from exiting the internal storage area while the bow case is rotated in any direction.

Yet another example is described below in which a bow case includes a bow case body with a bottom, a top, four sides, at least one leg that supports the body in a raised position, and an internal storage area, where left and right sides are inclined from a rear side to a front side. A mounting bracket that removably attaches the leg to the body and includes a socket for receiving the leg into the bracket. The mounting bracket is fixedly attached to the body and has at least one support attached between the socket and a surface of the mounting bracket. The support provides increased rigidity to the socket.

These and other features, advantages and benefits will become apparent to one of ordinary skill in the art upon careful consideration of the detailed description of representative examples below and the accompanying drawings, in which similar elements are indicated in the various figures using the same reference numbers.

BRIEF DESCRIPTION OF THE DRAWINGS

FIG. 4A is an enlarged scale partial cross-sectional view of a mounting bracket for the bow case mounted to an exterior of the bow case taken along line 4A-4A of FIG. 3.

FIG. 6 is a perspective top view of an internal storage cavity, in the bow case.

FIG. 7 is a perspective top view of the bow case with a lid to the internal storage cavity closed.

DETAILED DESCRIPTION

It is to be understood that the various embodiments of the present invention described herein may be utilized in various orientations and in various configurations, without departing from the principles of the present invention.

The embodiments are described merely as examples of useful applications of the principles of the invention, which is not limited to any specific details of these embodiments.

Figure 1:
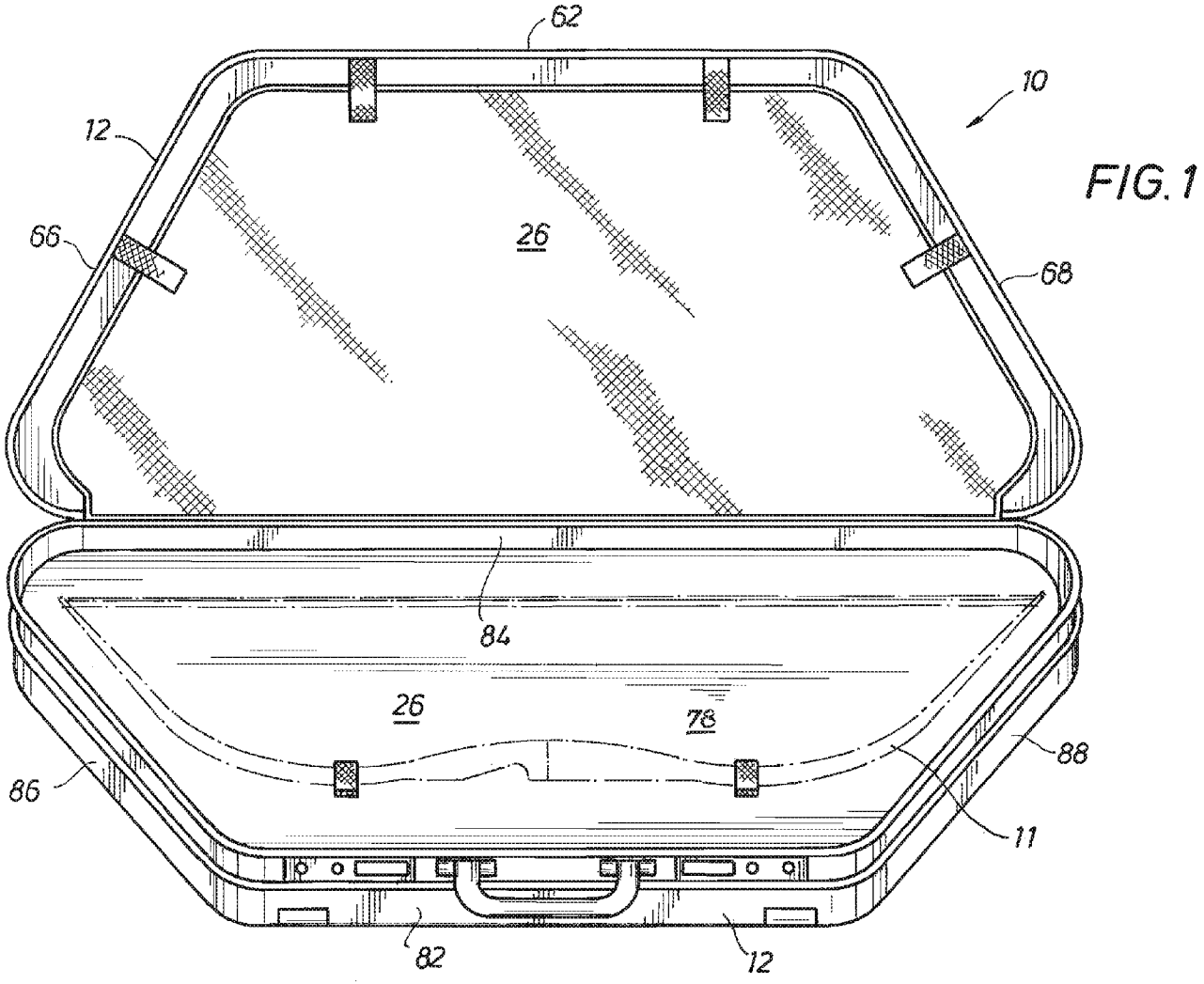
FIG. 1 is a perspective view of a bow case embodying principles of the present disclosure with the top open and an archery bow stored inside.

Representatively illustrated in FIG. 1 is a bow case 10, which embodies principles of this disclosure. The bow case allows an archer to organize and use archery equipment and additional items 56 (see FIG. 6) more efficiently. FIG. 1 shows at least one archery bow 11 being stored internally in the bow case.

Various activities, such as hunting, practicing, archery competitions, etc., can sometimes occur during harsh conditions, such as rain, mud, snow, etc. During these activities or others, such as packing for a trip or loading/unloading equipment at home or at a remote site, the archer needs efficient access to the equipment and/or the additional items 56.

Figure 2:
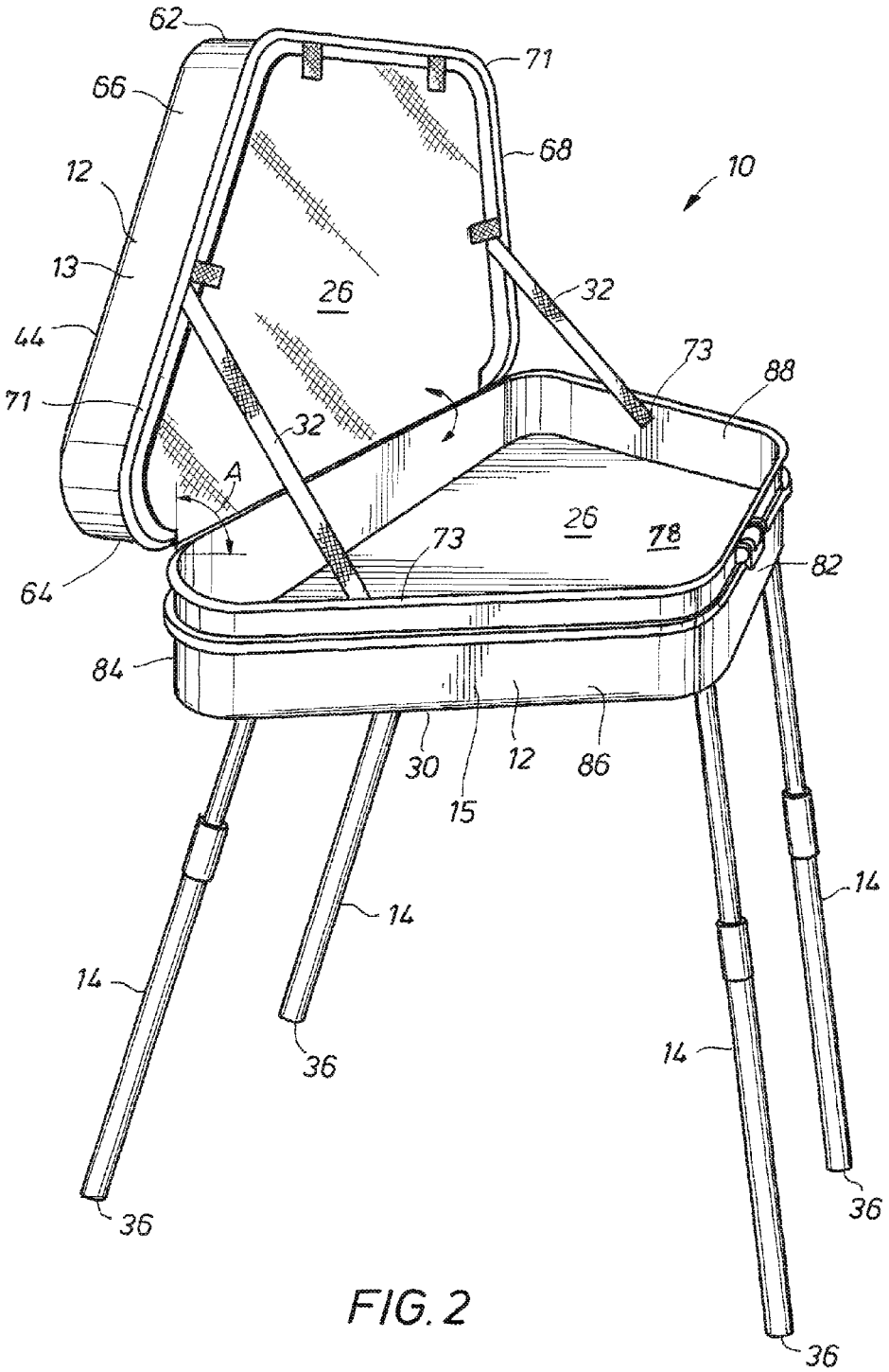
FIG. 2 is an isometric view of the bow case.

Referring now to FIG. 2, the bow case 10 includes a bow case body 12 and at least one leg 14 for supporting the body in a raised position. The preferred embodiment includes four legs, as illustrated in FIG. 2, but any number of legs can be used. For example, a single leg 14 can be connected to the bow case body 12 with attachment to a center 48 (see FIG. 3) of a bottom 30 of the body.

A single-leg embodiment would be required to support the full weight of the body 12 plus additional moments, and therefore, a larger leg may be preferred. These moments would result from forces applied to the body away from an attachment point of the leg to the body.

When multiple legs 14 are used to support the body 12, the legs are preferably attached around the perimeter of a bottom edge of the body and spaced apart to provide the optimum stability for that particular configuration of legs. It can be appreciated by those skilled in the art that any number of legs, such as 1, 2, 3, 4, 5, etc., can be used to support the bow case body without departing from the principles of this disclosure.

The bow case 10 is designed to facilitate mobility and improved access to equipment, which is desired when transporting archery equipment and any number of the additional items 56 to and from remote sites. These remote sites can be in the archer's backyard at home, across town, in a different state, a different country, etc. It is preferred, when transporting the archery equipment, to store all of the archery equipment and additional items 56 within a single carrying case for convenience and organization, as well as for protecting the equipment and these additional items 56 during travel. Upon arrival at a remote site, the bow case 10 may be deployed as shown in FIG. 2 to assist the archer in performing any required archery activities.

The legs 14 shown in FIG. 2 may be detached from the body 12 and stored in a storage compartment in the body for transport. The legs are preferably collapsible so that storage space, required for transport, can be minimized. However, it is not required that the legs be collapsible. For example, each leg may be a one-piece construction of any desired length to support the bow case body 12. In another configuration, the leg 14 may include multiple leg segments, which are assembled together to provide a desired leg length. Thus, it will be appreciated that various configurations of the leg are possible without departing from the principles of the present disclosure.

Figure 3:
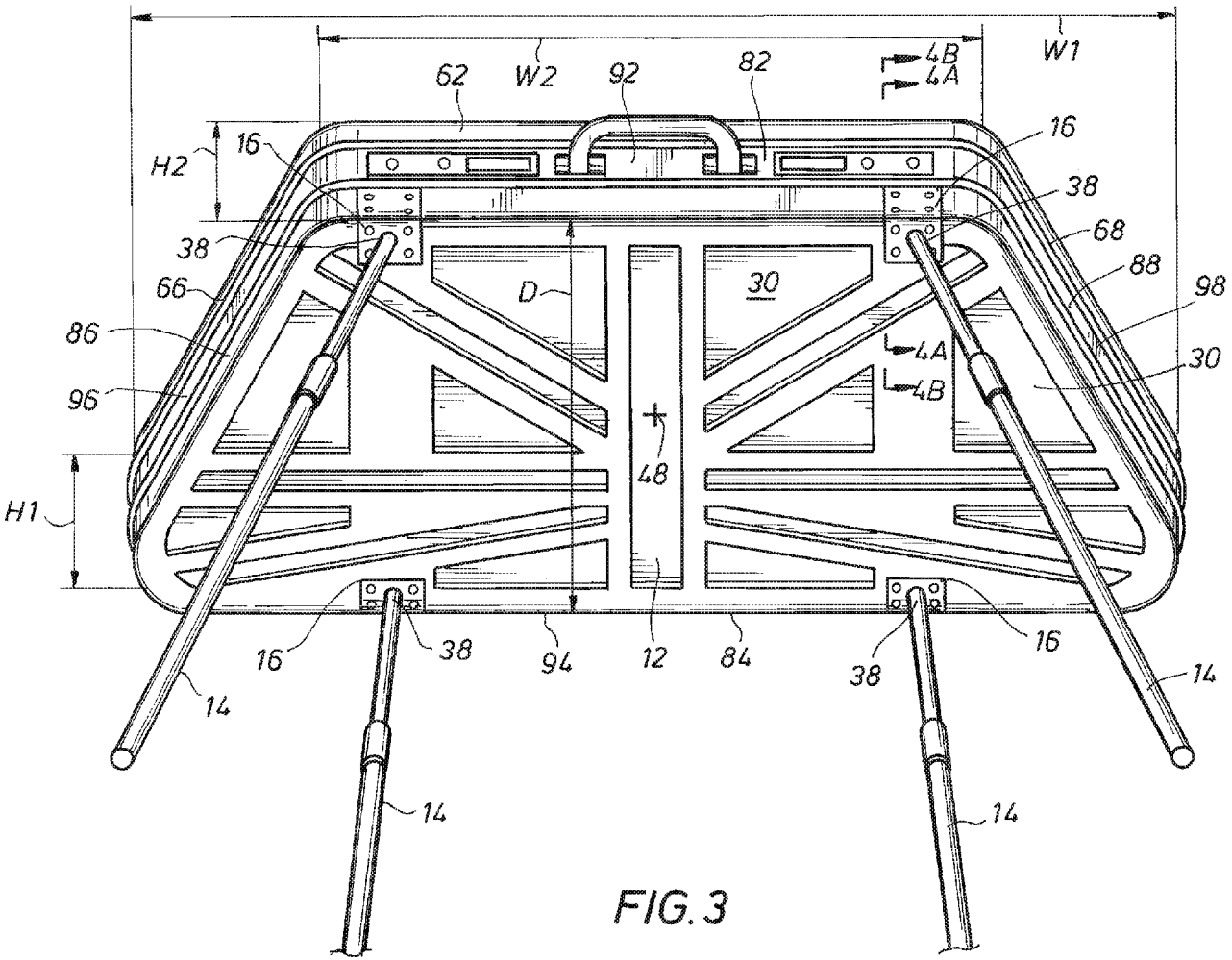
FIG. 3 is a perspective bottom view of the bow case.

The bow case body may include a bottom 30, a top 44, a front side 92, a rear side 94, a left side 96, and a right side 98 (see FIG. 3). The front side 92 may include upper and lower portions 62, 82, respectively. The rear side 94 may include upper and lower portions 64, 84, respectively. The left side 96 may include upper and lower portions 66, 86, respectively. The right side 98 may include upper and lower portions 68, 88, respectively.

The bow case body 12 may include an upper body portion 13 and a lower body portion 15. The upper portion 13 may include the front side 62, the rear side 64, the left side 66, the right side 68, and the top 44 (see FIG. 6). The lower portion 15 may include the front side 82, the rear side 84, the left side 86, the right side 88, and the bottom 30.

Preferably, the rear side 64 of the upper portion 13 is rotatably attached to the rear side 84 of the lower portion 15. Extension restrictors 32 may be used to prevent rotation of the upper portion 13 relative to the lower portion 15 past a predetermined angle A. Each restrictor 32 may be connected between the upper and lower portions 13, 15 and limit relative rotation of these portions by preventing extension of the restrictors past a predetermined length.

Each restrictor 32 may include a slideable structure that extends and retracts to vary the length of the restrictor 32, thereby restricting relative rotation of these portions 13, 15 between the extended and retracted positions of the restrictor 32. The restrictor 32 may also include multiple slideable structures.

Alternatively, or in addition to, each restrictor 32 may comprise a flexible strap that selectively folds and unfolds to allow relative rotation of these portions 13, 15 through the predetermined angle A and prevent relative rotation of these portions past the predetermined angle.

Each restrictor 32 may also include multiple straps. Each of the multiple straps may have attachment means (e.g. VELCRO™, snaps, buttons, etc.) which allow the multiple straps to be releasably attached to each other. When connected, the multiple straps prevent relative rotation of these portions 13, 15 past the predetermined angle A. However, when these multiple straps are disconnected, the portions 13, 15 are free to rotate past the predetermined angle A.

Referring now to FIG. 3, the bow case 10 is shown with four legs 14, each removably attached to mounting brackets 16 which are mounted to the lower portion 15 of the body 12. The bow case body 12 in this example is trapeziodally-shaped (which may otherwise be referred to as D-shaped). The front sides 62, 82 have a width W2 and the rear sides 64, 84 have a width W1. The width W1 is longer than the width W2. The rear sides 64, 84 are generally parallel to the front sides 62, 82. The left sides 66, 86 and right sides 68, 88 are inclined from the longer width W1 of the rear sides 64, 84 to the shorter width W2 of the front sides 62, 82 as shown in FIG. 3. Therefore, the lengths of these sides 66, 86, 68, 88 are longer than the distance D from the front sides 62, 82 to the rear sides 64, 84.

The bow case body 12 is shown in a closed configuration with the perimeter 71 of the upper portion 13 generally in contact with the perimeter 73 of the lower portion 15. "Generally in contact" is used in this example to represent that a large portion of each perimeter 71, 73 is in contact with each other. However, particular voids between the two perimeters 71, 73 may still exist, such as may be required for latches that connect the upper and lower portions 13, 15 together, or for any other feature that may interrupt these perimeters 71, 73. "Generally in contact" may additionally include a substance sandwiched between the perimeters 71, 73 to provide a seal or another interface between these perimeters.

The closed position of the bow case body 12 may prevent any contents stored in the body from existing the body (excluding contents stored in an internal storage cavity 50) regardless of an orientation of the body or when the body is rotated in any direction.

In the closed position, the bow case body 12 may have a height H1 at the rear of the body and a height H2 at the front of the body. Height H1 may be a different length than height H2. However, the preferred configuration is for heights H1 and H2 to be substantially equal.

The area of the rear side 94, which is calculated by multiplying the width W1 by the height H1, is substantially greater than the area of the front side 92, which is calculated by multiplying the width W2 by the height H2. Substantially greater requires that the area of the rear side 94 be larger than the area of the front side 92 by more than what may result from normal manufacturing tolerances.

Referring now to FIG. 4A, each leg 14 may be removably attached to the bottom 30 of the bow case body 12 by utilizing a mounting bracket 16. The mounting bracket is preferably attached to the lower portion 15 of the bow case body 12 with screws 34, but the mounting bracket may also be attached using glue or VELCRO or any other suitable attachment means. FIG. 4A shows the mounting bracket 16 attached to an exterior of the lower portion 15 of the bow case body 12.

Figure 4B:
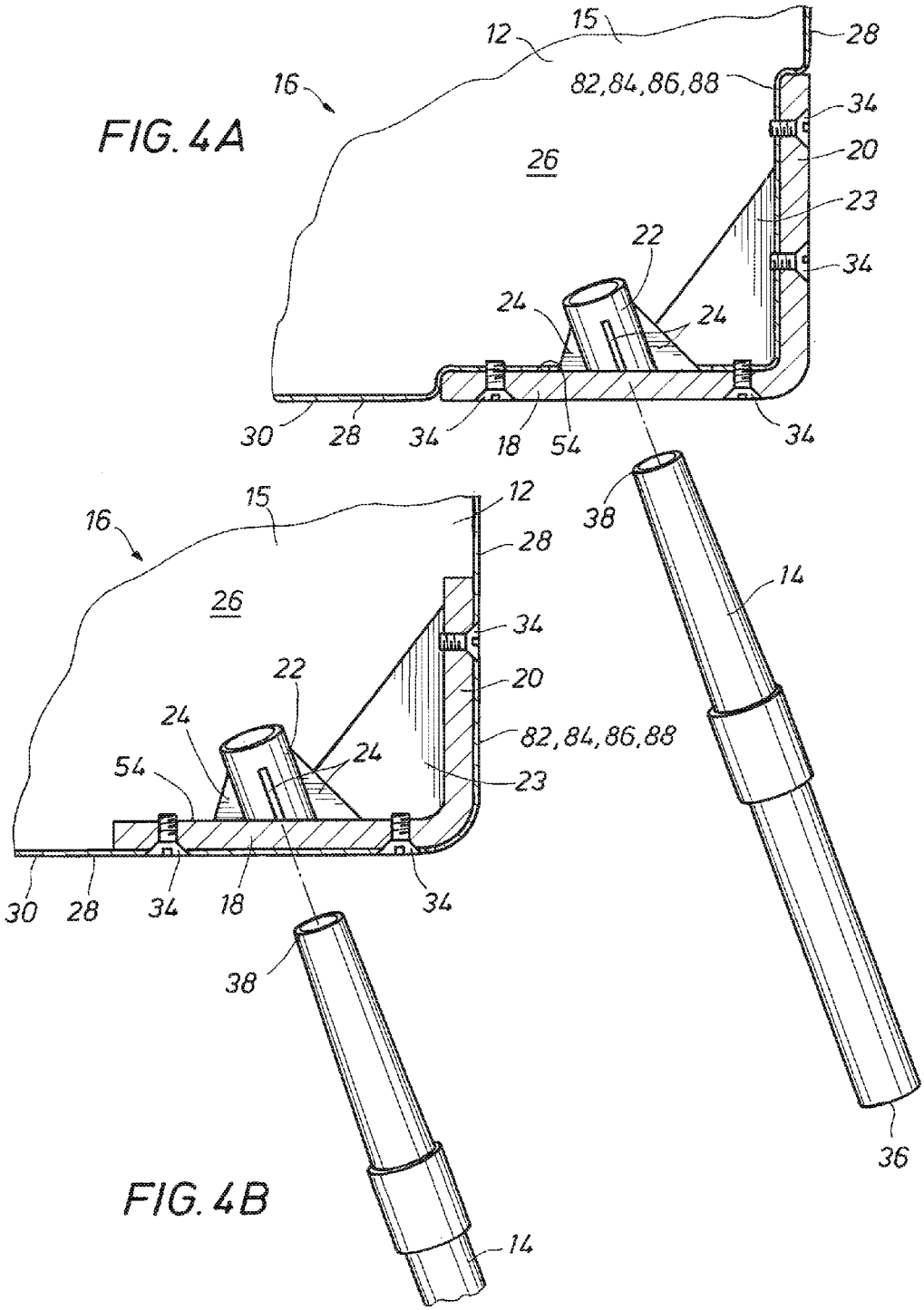
FIG. 4B is another configuration of an enlarged scale partial cross-sectional view of a mounting bracket for the bow case mounted to an interior of the bow case taken along line 4B-4B of FIG. 3.

Referring now to FIG. 4B, another configuration is shown where the mounting bracket is attached in an interior of the lower portion 15 of the bow case body 12.

In yet another configuration, the mounting bracket 16 may be integrally formed with the bow case body 12 when the body is manufactured (not shown), thus reducing the number of assembly steps required to produce the bow case 10. Therefore, it will be appreciated that various means can be used to incorporate the mounting bracket 16 in the bow case body 12 without departing from the principles of this disclosure.

As shown in FIG. 4A, the bracket 16 may be recessed toward an interior 26 of the body 12 and mounted flush with an exterior wall 28 of the body to minimize any exterior protrusions. Exterior protrusions interfere with baggage handling systems, such as at airports, and generally make handling an item more difficult. Therefore, the mounting bracket 16 is preferably recessed into the body 12, adjacent to the exterior wall 28, to assist in handling ease.

However, it is not required that the mounting bracket be recessed into the body and adjacent to the exterior wall. The mounting bracket 16 may be mounted directly to the exterior wall 28 and not recessed into the body. As stated above, the mounting bracket may also be integrally formed with the body 12 when the body is manufactured and therefore the bracket would be a continuation of the exterior wall 28 and the body 12. It will be appreciated that there are various ways that the bracket 16 can be provided as a feature of the bow case body 12 without departing from the principles of this disclosure.

Each mounting bracket 16 may include a base 18, a flange 20, supports 21, 23, 24, and a socket 22 for removably attaching the leg 14 to the bow case body 12. The mounting brackets are preferably mounted around the perimeter of the bow case body 12, and attached to the bottom 30 and at least one of the front side 82, rear side 84, left side 86, and right side 88 of the lower portion 15 of the body 1.

Figure 5:
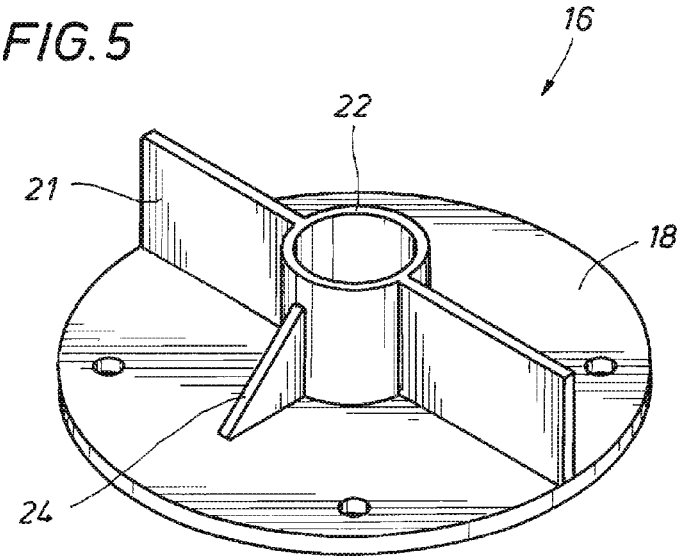
FIG. 5 is a perspective view of a single-leg mounting bracket.

However, when a single leg 14 is used to support the body, then another configuration of the mounting bracket 16, as shown in FIG. 5, may be mounted in the center 48 (FIG. 3) of the bottom 30 of the body. In this configuration, the mounting bracket 16 does not contact any of the sides 82, 84, 86, and 88 of the lower portion 15 of the body 12. A support 21 is relatively perpendicular to the base 18, which provides rigidity to the mounting bracket 16. It will be appreciated that multiple supports 21 may be used to strengthen the bracket 16.

Again referring back to FIG. 4A, the socket 22 is attached to the base 18 and extends from the base 18 toward the interior 26 of the bow case body 12. At least one support 24 is attached between the surface 54 of the base of the mounting bracket 16 and the socket 22. This provides increased rigidity of the socket and support for the leg 14 when the leg is inserted into the socket. The support 24 and the socket 22 may be attached to the surface 54 in various ways, such as welding, gluing, using screws, etc.

At least one support 23 is attached between the surface 54 and the flange 20. This provides increased rigidity of the mounting bracket. The support 23 may also be attached in various ways, such as welding, gluing, using screws, etc.

In another configuration, the mounting bracket 16 may be formed through processes such as plastic injection molding or metal casting. These processes form a single piece product, which may have the base 18, flange 20, socket 22, and supports 21, 23, 24 (features of the bracket 16) already included in a single piece construction. If the bracket 16 were integrally formed with the bow case body 12, no attachment means would be required. Therefore, it will be appreciated that various means can be used to provide the features of mounting bracket 16 (e.g. supports 21, 23, 24, socket 22, base 18, and flange 20) without departing from the principles of this disclosure.

Material used to manufacture the mounting bracket 16 may include metals, plastics, etc. Plastic may be preferred to minimize the weight of the bow case 10, but metal may be preferred to maximize the rigidity of the mounting bracket.

The socket 22 may be attached to the base 18 in such a way as to cause the leg 14, once installed in the socket 22, to extend relatively perpendicular to the bottom 30.

This is preferred when a single leg 14 is used to support the body 12. However, when multiple legs are used, socket 22 is preferably attached, or formed, to the base 18 slightly tilted towards the center 48 of the body, as shown in FIGS. 4A and 4B. This results in a perimeter, defined by the bottoms 36 of the legs 14, being larger than a perimeter defined by the tops 38 of the legs.

The socket 22 receives the leg 14 for supporting bow case 10 in a raised position off the ground, or a floor, or any surface on which the archer desires to place the bow case 10. The socket may be cylindrically shaped as shown in FIGS. 4A and 4B, but the socket is not required to be cylindrically shaped. The socket may be rectangular, square, oval, star shaped, or any other shape that accepts a similarly shaped leg 14 into the socket 22. When inserted into the socket, the leg may be kept in the socket by gravitational forces acting on the weight of the body 12.

However, it is preferred that the leg 14 be positively held in the socket by an interference fit between the leg and the socket. In this example, the leg includes a slight taper at the top end 38. When end 38 is inserted into the socket 22, the end travels into the socket until friction force on an outside wall of the end 38 and an inside wall of the socket 22 acts to positively retain the end in the socket.

The friction may retain the end 38 in the socket 22 until the archer needs to pack up the archery equipment for transport. The end may then be removed from the socket 22 by applying enough force to dislodge the end 38 from the socket. However, it is not necessary that the end 38 be retained in the socket 22 of bracket 16 by friction. In another configuration, the end 38 and socket 22 may have mating threads and the end may be screwed into the socket. Therefore, it will be appreciated that various means can be used to attach the end 38 to the socket 22 without departing from the principles of this disclosure.

To prepare the bow case 10 for transport, the archer may detach any leg 14 used to support the bow case body 12, collect any additional items 56 needed for the upcoming archery activity, collect the archery bow, and store these items in the bow case 10. Internal storage areas 74, 76, 78 (see FIGS. 2-3, 10-11) in the interior 26 of the bow case body may be used to store the archery bow, the additional items 56, and the leg(s). However, it is preferred that at least some of the additional items 56 and possibly the leg(s) be stored in an externally accessible internal storage cavity 50.

Referring now to FIG. 6, the internal storage cavity 50 of the bow case 10 provides storage for additional item(s) 56 and at least one leg 14. In this example, the cavity 50 provides storage for four legs and at least one additional item 56, but it is not necessary that the internal storage cavity 50 store four legs. The cavity 50 may store any number of legs as desired, in keeping with the storage requirements of the various examples of the bow case 10.

The internal storage cavity 50 is preferably mounted in the center 46 (refer to FIG. 7) of the top 44 of the bow case body 12 and recessed into the bow case body 12. The internal storage cavity 50 may include a lid 52 used to secure the contents of cavity 50 for transport. However, a lid 52 is not required to secure the contents in the cavity 50. Alternatively, or in addition to, many other securing means may be used, such as VELCRO, nylon straps, elastic straps, slotted foam pads, etc., without departing from the principles of this disclosure.

Figure 10:
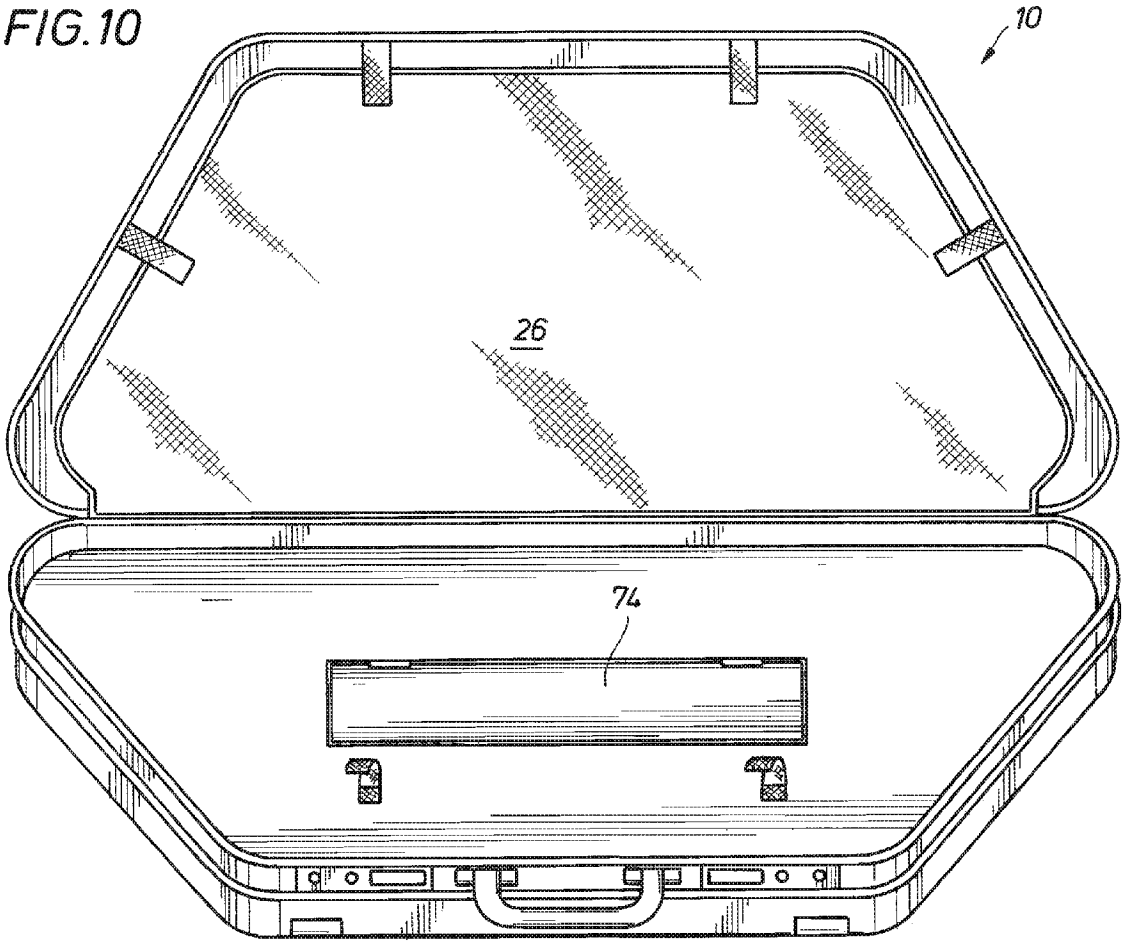
FIG. 10 is a perspective view of the bow case with the top open.
Figure 11:
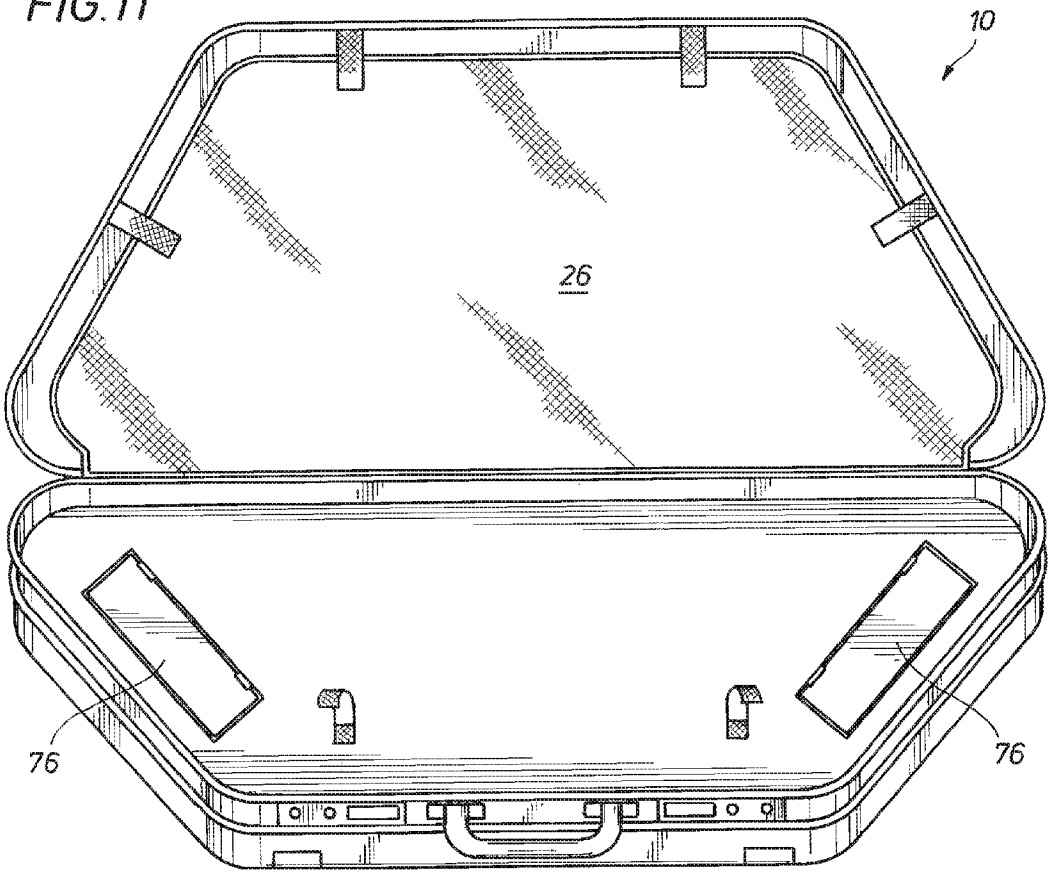
FIG. 11 is another configuration of the bow case with the top open.

Any items (e.g. contents) stored in internal storage areas of the bow case body 12 (e.g. area 78 as seen in FIGS. 2 and 3, areas 74, 76 as seen in FIGS. 10 and 11) are prevented from exiting the body while the body remains closed, regardless of an orientation of the body or if the body is rotated in any direction. However, the internal storage cavity 50 may be externally accessible while the bow case body 12 remains closed. This permits the archer to retrieve tools more easily.

This is beneficial when the bow case 10 is loaded in a vehicle for a journey, for example, with other things that may be required for a journey. With external access to the internal storage cavity 50, the archer may not have to unload as many items as would be required if the archer had to retrieve items from inside the case. Bow cases having only internal storage compartments require opening the bow case in order to retrieve items from the compartments.

With the bow case 10 in a raised position, the archer may need an additional item (e.g. a tool), which is stored in the bow case, for adjusting an archery bow. If the archer has placed an archery bow or tool or even a drink on the top of bow case, these items would have to be removed to access internal storage compartments. To at least partially alleviate this problem, external access to contents of the internal storage cavity 50 is provided. This permits the archer to retrieve stored items from the cavity 50 without opening the bow case body 12.

Figure 8:
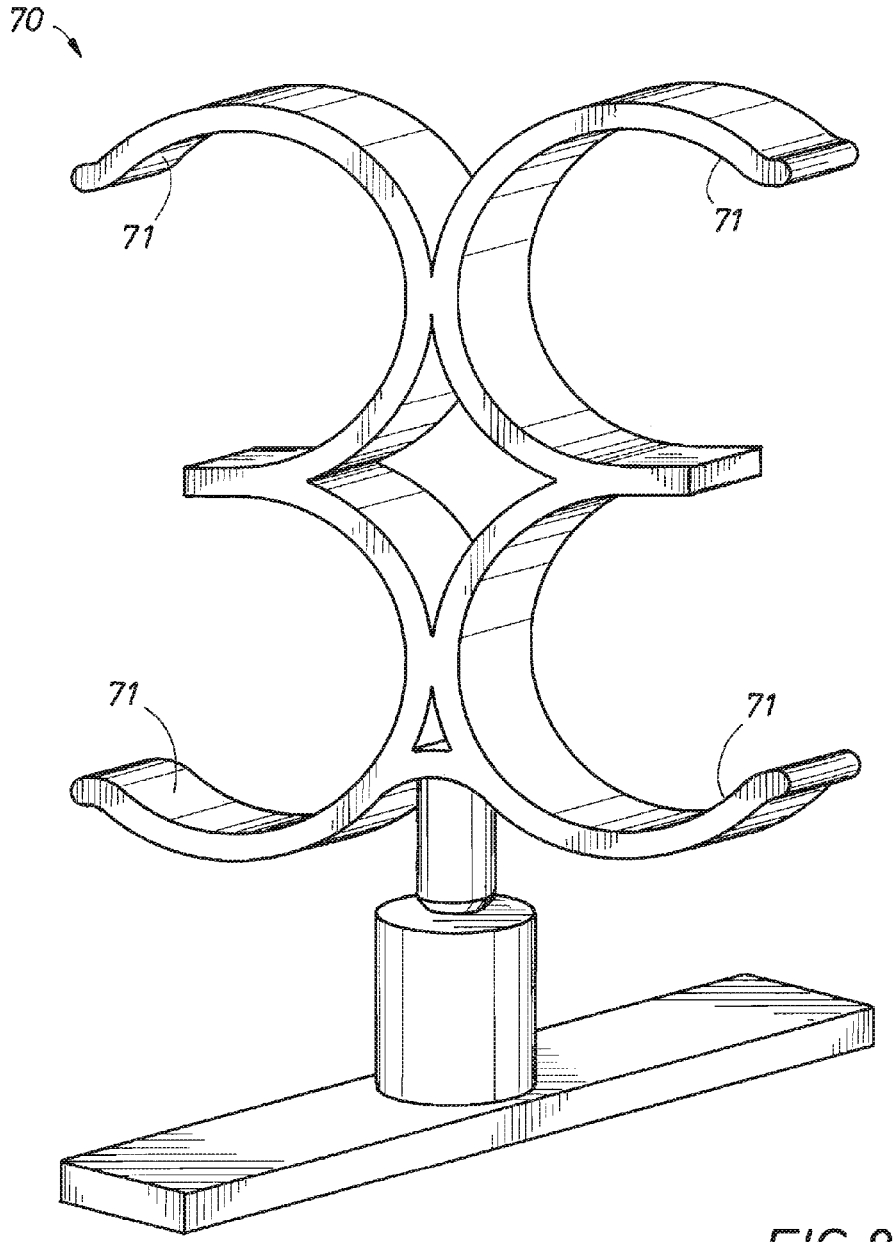
FIG. 8 is an isometric view of a four-leg support bracket.

The internal storage cavity 50 may include separate storage areas. For example, legs 14 may be stored in one area 58 and any additional items 56 may be stored in another area 60. Area 58 may contain several types of retainers for securing the legs 14 in the internal storage cavity 50. For example, a four-leg bracket 70, shown in FIG. 8, may be used to secure up to four legs in the storage area 58. A pair of four-leg brackets may be used to secure the legs. Each bracket 70 may be spaced apart and attached within the storage area 58. The spacing of brackets 70 depends on the length of the legs 14 being secured. The legs may be snapped into retention features 71 of the brackets 70.

Figure 9:
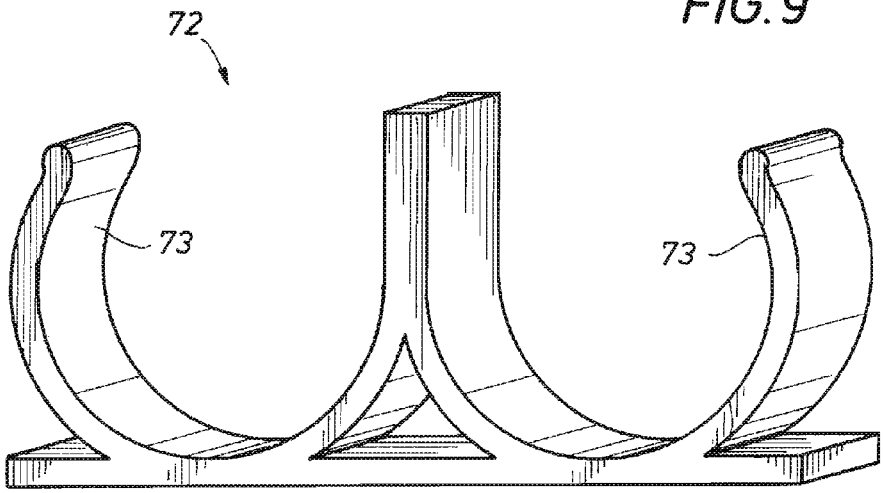
FIG. 9 is an isometric view of a two-leg support bracket.

In another configuration, a two-leg bracket 72, shown in FIG. 9, may be used to secure the legs in the storage area 58. One pair of brackets 72 may secure two legs. Each bracket of the pair would be spaced apart and attached within the storage area 58. The spacing of brackets 72 would depend on the length of the legs 14 being secured. The legs may be snapped into retention features 73 of the brackets 72.

Multiple pairs of either brackets 70 or 72 may be used to secure a desired number of legs 14. In a preferred example of the bow case 10, four legs are used to support the bow case body 12 in a raised position; therefore, a single pair of brackets 70 or two pairs of brackets 72 may be used to secure the legs in the storage area 58.

It will be appreciated that brackets 70 can be used together with brackets 72. It will also be appreciated that neither of these brackets are required to secure the legs in the storage area 58. Many other securing means may be used, such as VELCRO, nylon straps, elastic straps, slotted foam pads, etc., without departing from the principles of this disclosure.

Regarding the manufacture of the internal storage cavity 50, it will be appreciated that the cavity can be manufactured separately and attached to the bow case body 12 by suitable means, such as screws, glue, welding, etc.

This allows different versions of the internal storage cavity 50 to be substituted in the assembly process without requiring significant modifications to the manufacturing process.

However, the internal storage cavity 50 can also be manufactured with the bow case body in a single manufacturing process such as plastic thermal forming or molding or other processes well known in the art. Therefore, it is not necessary that the internal storage cavity 50 be manufactured separately from the bow case body. It will be appreciated that there are many ways to manufacture the bow case body 12 with an internal storage cavity 50 without departing from the principles of this disclosure.

Additional items 56 may be similarly secured in the storage area 60 using VELCRO, nylon straps, elastic straps, slotted foam pads, etc. The additional items 56 may also be secured in area 60 by the lid 52. It will be appreciated that many securing means may be used without departing from the principles of this disclosure.

Referring now to FIG. 10 and FIG. 11, the bow case 10 may also include internal storage compartments, in addition to the internal storage cavity 50. These internal storage compartments provide the archer with more options when preparing for and traveling to/from an archery event. For example, it may be desirable to store the legs 14 in internal storage areas 74 or 76 instead of in the cavity 50. In the preferred example of bow case 10, four legs 14 are used to support the bow case body 12 in a raised position. These four legs may be stored internally in storage areas 74 or 76 with similar securing means to those described above for securing the legs in the storage area 58. The positions of areas 74 and 76, shown in FIGS. 10 and 11, are only examples of where these areas may be located. These positions are not requirements for the bow case 10 as other positions may be used without departing from the principles of this disclosure.

It will now be fully appreciated that the above disclosure provides several advancements to the art of storage cases for archery equipment. In examples described above, a bow case 10 may include a mounting bracket 16, which attaches a leg 14 to a body 12. In addition, examples described above provide an externally accessible storage cavity 50 for the bow case 10.

The above disclosure provides to the art a bow case 10 that may include a bow case body 12, which may include a bottom, a top 44, a front side 92, a rear side 94, a left side 96, and a right side 98, and an internal storage area 74, 76, 78, where the rear side 94 of the body 12 has a substantially greater area as compared to the front side 92 of the body 12.

The body 12 may also include a leg 14 removably attached to the body 12, where the leg 14 supports the body 12 in a raised position. A mounting bracket 16 may removably attach the leg 14 to the body 12. The mounting bracket 16 simultaneously contacts both the bottom 30 and one of a front side 82, a rear side 84, a left side 86, or a right side 88 of a lower portion 15 of the body 12.

A support 23 may be attached between a flange 20 and a base 18 of the mounting bracket 16. The mounting bracket may include a socket 22 that receives the leg 14.

A support 21, 24 may be attached between the socket 22, which may be tapered, and a surface 54 of the mounting bracket 16. The leg 14 may be collapsible to a reduced length.

The body 12 may include an internal storage cavity 50 adjacent the top 44 of the body 12, where a leg 14 and/or an additional item 56 may be stored in the cavity 50. The contents stored in the cavity 50 may be externally accessible while the body remains closed. A leg 14 and/or an additional item 56 may also be stored in the internal storage area 74, 76, 78.

Also provided by the above disclosure is a bow case 10 that may include a bow case body 12, which may include a bottom, a top 44, a bottom 30, an internal storage area 74, 76, 78, and an internal storage cavity 50, where the bow case body may be trapezoidally shaped.

The cavity 50 may be externally accessible while the body 12 remains closed, and any contents stored in the internal storage area 74, 76, 78 may be prevented from exiting the body 12 as the body 12 is rotated in any direction while the body 12 is closed.

A restrictor 30, connected between upper and lower portions 13, 15 of the body 12, may prevent rotation of the upper portion 13 past a predetermined angel of rotation A relative to the lower portion 15. The upper portion 13 may be rotatably attached to the lower portion 15.

A leg 14 and/or an additional item 56 may be stored in the cavity 50. A leg 14 may support the body 12 in a raised position, and the leg 14 may be collapsible to a reduced length.

A mounting bracket 16 may removably attach the leg to a bottom 30 of the body 12, and the mounting bracket 16 may simultaneously contact the bottom 30 of the body 12 and one of a front side 82, a rear side 84, a left side 86, and a right side 88 of a lower portion 15 of the body 12.

The mounting bracket 16 may include a socket which receives the leg 14, and a support 21, 24 attached between the socket 22 and a surface 54 of the mounting bracket 16.

A restrictor connected between upper and lower portions of the bow case body, wherein the upper portion is rotatably attached to the lower portion, and wherein the restrictor prevents rotation of the upper portion past a predetermined angel of rotation relative to the lower portion.

Also provided by the above disclosure is a bow case 10 that may include a bow case body with a bottom 30, a top 44, a front side 92, a rear side 94, a left side 96, and a right side 98, wherein the left and right sides 96, 98 are inclined from the rear side 94 to the front side 92, and an internal storage area 78 within the body 12.

A leg 14 may support the body 12 in a raised position. A mounting bracket 16 may removably attach the leg 14 to the body 12, and the mounting bracket 16 may include a socket 22 which receives the leg 14 therein. The mounting bracket 16 may be fixedly attached to the body 12, and at least one support 21, 24 attached between the socket 22 and a surface 54 of the mounting bracket 16.

At least one support 23 may be attached between a flange 20 of the mounting bracket 16 and a base 18 of the mounting bracket 16.

Contents stored in an internal storage cavity 50 in a top 44 of the body 12 may be externally accessible while the body 12 remains closed, and contents stored in the internal storage area 74, 76, 78 are prevented from exiting the body 12 when rotating the body 12 in any direction while the body 12 is closed.

A restrictor 30, connected between upper and lower portions 13, 15 of the bow case body 12, may prevent rotation of the upper portion 13 past a predetermined angel of rotation A relative to the lower portion 15.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "bottom," "top," "front side," "rear side," etc., are used for convenience in referring to the accompanying drawings. However, the principles of this disclosure are not limited to any of these specific details.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A bow case comprising:

a bow case body including:

an upper portion with a top;

a lower portion with a bottom, wherein the upper and lower portions of the bow case body are each trapezoidally shaped;

an internal storage area, wherein any contents stored in the internal storage area are prevented from exiting the body as the body is rotated in any direction while the body is closed, wherein the contents stored in the internal storage area are permitted to exit the body when the body is open, wherein the upper and lower portions of the body are rotatably attached to each other, wherein the body is closed when the upper portion is rotated into engagement with the lower portion, and the body is open when the upper portion is rotated out of engagement with the lower portion;

an internal storage cavity that is recessed in the top of the upper portion of the bow case body, wherein the internal storage cavity is isolated from the internal storage area and the internal storage cavity is externally accessible while the body remains closed; and a mounting bracket which removably attaches a leg to the bottom of the body, wherein the mounting bracket simultaneously contacts the bottom of the body and at least one of a front side, a rear side, a left side, and a right side of the lower portion of the body, wherein the mounting bracket includes a socket which is tapered and receives the leg therein, and wherein at least one support is attached between the socket and a surface of the mounting bracket.

2. The bow case of claim 1, wherein at least one of an additional item and the leg is stored in the cavity.

3. The bow case of claim 1, wherein the leg supports the body in a raised position, and wherein the leg is collapsible to a reduced length.

4. The bow case of claim 1, wherein the mounting bracket is attached to the body from within the internal storage area.

5. The bow case of claim 1, wherein the mounting bracket contacts an exterior of the body.

6. The bow case of claim 1, further comprising at least one restrictor connected between upper and lower portions of the bow case body, wherein the restrictor prevents rotation of the upper portion past a predetermined angel of rotation relative to the lower portion.

* * * * *